United States Patent [19]

von der Bey et al.

[11] Patent Number: 4,532,779

[45] Date of Patent: Aug. 6, 1985

[54] DEVICE FOR GENERATING A DRY, COLD AIR FLOW FOR TREATMENT OF RHEUMATIC DISEASES

[75] Inventors: Thomas von der Bey, Ratingen; Detlef Jankowski, Duisburg; Hartmut Schmidt, Meerbusch; Klemens Thoma, Krefeld; Wolfgang Volker, Tönisvorst, all of Fed. Rep. of Germany

[73] Assignee: Messer Griesheim GmbH, Fed. Rep. of Germany

[21] Appl. No.: 573,838

[22] Filed: Jan. 25, 1984

[30] Foreign Application Priority Data

Feb. 17, 1983 [DE] Fed. Rep. of Germany ..... 3305434

[51] Int. Cl.[3] ..... F25B 19/00

[52] U.S. Cl. ..... 62/514 R; 62/93

[58] Field of Search ..... 62/93, 514 R

[56] References Cited

U.S. PATENT DOCUMENTS

| | | | |
|---|---|---|---|
| 3,854,300 | 12/1974 | Gerhold | 62/93 |
| 4,114,287 | 9/1978 | Fraser | 62/55.5 |
| 4,116,017 | 9/1978 | Oberpriller | 62/514 R |
| 4,164,127 | 8/1979 | Baumgartner | 62/514 R |
| 4,237,700 | 12/1980 | Rothchild | 62/514 R |

FOREIGN PATENT DOCUMENTS 3018980 2/1980 Japan .

*Primary Examiner*—Ronald C. Capossela

*Attorney, Agent, or Firm*—Connolly and Hutz

[57] ABSTRACT

A device for generating a dry, cold air flow in the treatment of rheumatic diseases includes a cyclone separator as its heat exchange device. The intake line of the cyclone separator is connected to the outlet line of the blower means of a line in which the cryogenic liquefied gas feed ends. The outlet opening of the cyclone generator has attached to it an insulated flexible hose.

2 Claims, 2 Drawing Figures

DEVICE FOR GENERATING A DRY, COLD AIR FLOW FOR TREATMENT OF RHEUMATIC DISEASES

BACKGROUND OF INVENTION

The invention concerns a device for generating a dry, cold air flow for treatment of rheumatic diseases.

Cold therapy for treatment of rheumatic diseases was developed some years ago in Japan and is increasingly gaining recognition. Both whole body therapy and local therapy has been applied. In whole body therapy, the patient must remain in a severly chilled room for a specific period of time. In local therapy, a cold air flow is directed onto the diseased body portion. The invention concerns a device for local therapy.

The cold air flow for local therapy must be dry and free of ice. Since the air is cooled to approximately −150° C., it is by nature dry, but the ice particles removed from the air by freezing must be prevented from impacting on the body surface. This would cause cold damages at least in the form of micronecroses.

From the Japanese disclosure document for design registration, No. 30 189/80 (Application No. 114 029/78), a device is known for generating a dry, cold air flow for treatment of rheumatic diseases, which fulfills the above-mentioned requirements. In this device, the air flow generated by means of a blower is led through an air cooler, in which it is cooled to the required low temperature. This air cooler is a heat exchanger with cooling hoses, in which liquid nitrogen is being evaporated. The moisture is frozen out at these cooling hoses. The dry cold air is removed from the air cooler through an insulated hose and fed to the treatment location.

Although this device fulfills its purpose in a satisfactory manner, it has some disadvantages, particularly in respect to economy. Thus, the investment costs are relatively high, since the heat exchanger for the air cooling is expensive. The heat exchanger must be set up outside of the treatment rooms. For this reason, long feed lines are required. The long hose line for the cold air is also expensive, due to the cost of the insulation. When the device is started up, it is necessary to first cool the heat exchanger with its great mass as well as the hose lines, before it is possible to give the patient the cold treatment. The start-up times are thus considerable. The loss of cooling agent per treatment is correspondingly great. If the device is being used for a longer period of time without interruption, which is frequently the case in the practice, the moisture frozen out of the air may ice the surfaces of the heat exchanger and cause a failure of the device. This can be prevented only if the operation of the equipment is set for regular intervals to thaw off the accumulated moisture.

SUMMARY OF THE INVENTION

The purpose of the invention is to create a device for generating a dry, cold air flow for treatment of rheumatic diseases, which does not have these disadvantages but is particularly ready for rapid use with low cooling agent consumption and suitable for constant use.

A device was designed for generating a dry, cold air flow for treatment of rheumatic diseases, with a connection to a feed line for a cryogenic liquefied gas, a blower for generating the air flow, and a device for heat exchange between liquefied gas and air flow, which makes possible a separation of the frozen out moisture, whereby, according to the invention, a cyclone separator serves as heat exchanger, the intake line of which is connected over a line with the outlet opening of the blower, in which the connection for feeding the liquefied gas ends, and at the outlet opening of which a flexible hose is attached.

Accordingly, the principle of the invention is to design a device where there is a direct heat exchange between the cryogenic liquefied gas, generally nitrogen, and the air. For this purpose, the liquefied gas is sprayed into the intake line of a cyclone separator. The air is thereby immediately and greatly cooled, and the moisture contained therein freezes out in the form of ice particles.

The heat exchange is continued in the cyclone separator, and the ice is separated. The separated moisture collects in the lower part of the cyclone separator, thaws out there and is discharged from time to time in the form of water, e.g., during interruptions in the operation of the device.

When liquid nitrogen is used as a cooling agent, physician and patient may be endangered due to excessive nitrogen content in the breathing air. In order to eliminate this danger, a ventilator for discharging air is installed in the vicinity of the device according to the invention which is automatically activated when the device is started up. In addition, an electrical blockage may serve the purpose of interrupting the feed of liquid nitrogen if the air discharge fan does not operate. However, such safety devices would be superfluous if liquid air is used as a cooling agent.

THE DRAWINGS

FIG. 1 is a perspective view of a device with separate, removable supply container for liquid nitrogen; and FIG. 2 is a schematic representation of the device according to FIG. 1 combined with an air discharge fan.

DETAILED DESCRIPTION

Figure 1:
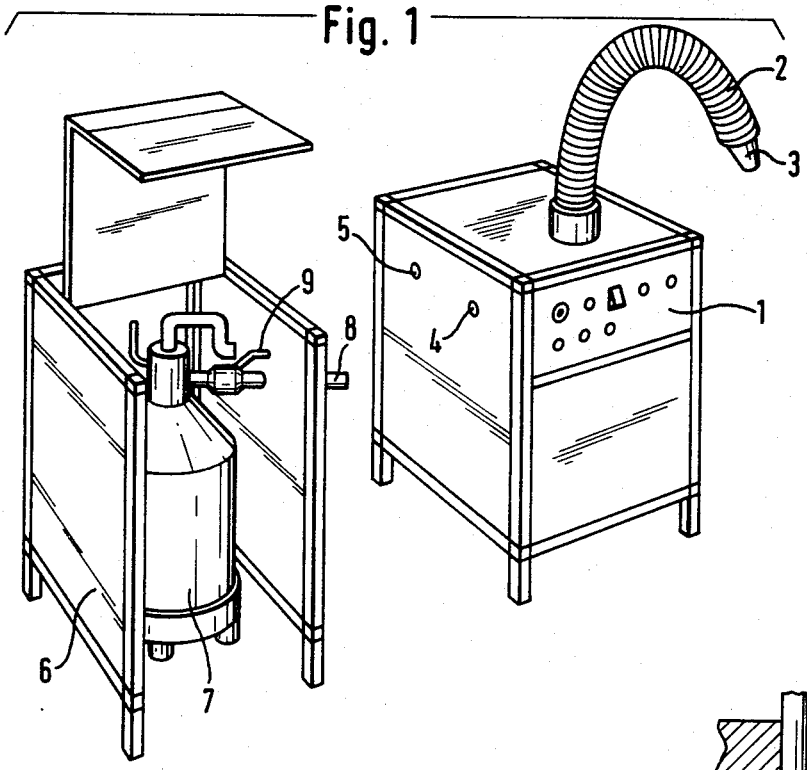

The equipment for generating the cold air flow is contained in the interior of the device represented in FIG. 1; start-up and monitoring are achieved by means of instrumentation and switches on the front side 1 of the device. A flexible insulated hose 2 leads out of the device and ends in a hand-held piece 3. Further, the device has a connection opening 4 for liquid nitrogen feed and a plug 5 for establishing an electrical connection. Furthermore, the device has a separate, removable supply container 6 for liquid nitrogen. In the interior of this supply container 6 is the actual nitrogen container 7. It also has a connection 8, over which liquid nitrogen can flow out of the liquid nitrogen container 7. In addition, there is a plug 9 for electrical connection. The device is ready for operation as soon as the supply container 6 is connected, whereby the plugs 5 and 9 as well as the connection opening 4 and the connection 8 are engaged.

Figure 2:
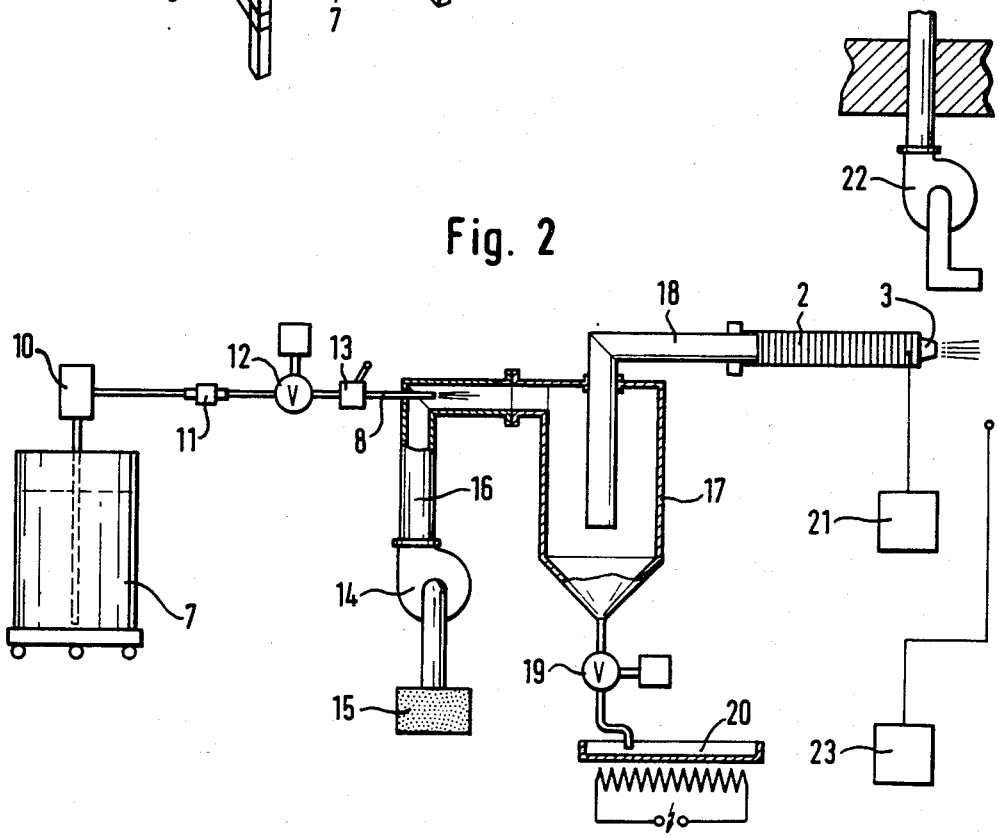

FIG. 2 is a schematic representation of the device in FIG. 1. Liquid nitrogen is drawn from the nitrogen container 7 by means of the pump 10. The rapid coupling 11 represents the connection between the connection point 8 and the connecting opening 4. In the connection 8, which is lengthened by means of the rapid coupling 11, there is also a magnet valve 12 and an adjustable diaphragm 13. The air flow is generated by a blower 14, which suctions in air through the filter 15.

The outlet opening of the blower 14 is connected to intake opening of a cyclone separator 17. According to the invention, the connection 8 from the nitrogen container 7 ends in the line 16. The insulated hose 2 with the hand-held piece 3 is attached to the outlet connectors 18 of the cyclone separator 17. At the lower, conical part of the cyclone separator 17, there is a valve 19, to which is connected a discharge water separator and evaporator 20. In the vicinity of the hand-held piece 3, there is a temperature measurement device 21. In the vicinity of the device, there is also an air discharge fan 22. By means of an electrical connection, which is not shown, it is also achieved that the nitrogen feed is interrupted by the magnet valve 12 if the air discharge fan 22 does not function, e.g., due to a technical defect. Also in the vicinity of the device according to the invention, there is a warning device 23 for the oxygen level; however, this does not have a functional connection with the device according to the invention.

When the device is started up, the air discharge fan 22, the blower 14 and the pump 10 are simultaneously activated. Thereby, liquid nitrogen is sprayed into the line 16 through the connection 8. There is then a direct heat exchange between the nitrogen sprayed into the line 16 and the air from the blower 14. Since both the line 16 and the cyclone separator 17 have little mass, the entire device is rapidly cooled, so that only little nitrogen is required for cooling the device according to the invention to its operating temperature. The moisture contained in the air from the blower 14 freezes out in the form of ice particles, which are separated in a known manner by means of the cyclone separator 17. They collect in the lower, conical part of the cyclone separator 17, where they thaw out again and are discharged from time to time through the valve 19 into the discharge water separator and evaporator 20. The dry, cold air with some admixture of nitrogen leaves the cyclone separator 17 through outlet connectors 18, insulated flexible hole 2, and hand-held piece 3. It then arrives directly onto the body portion to be subjected to the treatment. The temperature of the air flow is monitored and adjusted by means of the temperature measurement device 21. The temperature adjustment is extremely simple, since only the quantity of sprayed-in nitrogen need be varied. The air quantity can also be easily varied by means of changing the speed of the blower 14. The air mixed with nitrogen is constantly being suctioned out by means of the air discharge fan 22. Should the oxygen level nevertheless fall below a permissible value, this will be optically and acoustically indicated by means of the oxygen warning device 23.

The device according to the invention is a compact unit, which can be set up in any room without external feed lines. The supply container 6 can easily be exchanged at any time when the nitrogen in the container 7 is running out. Since the liquid nitrogen can be stored in small quantities directly in the treatment room, it is possible to utilize the very shortest connections. The only requirement is a connection to the electrical power supply. The quantities of air and liquid nitrogen which are to be mixed with one another may be adjusted separately and independently of one another. The temperature of the cold air flow can be preselected and adjusted according to desire or requirement. The device is ready for operation within very short time. The ice separation in the cyclone separator 17 is safe and reliably prevents ice particles to touch the body surface of the patient which could cause cold injuries due to micronecroses.

What is claimed is:

1. In a device for generating a dry, cold air flow for treatment of rheumatic diseases, the device having a connection connected to a supply of a cryogenic liquefied gas, a blower in flow communication with the device and the gas supply for generating the air flow, and a unit communicating with the device for heat exchange between liquefied gas and air flow, with possibility of separating the frozen-out moisture, the improvement being said heat exchange unit being a cyclone separator, said cyclone separator having an intake line connected to the outlet line of said blower by means of a further line in which said connection for the liquefied gas feed ends, and said cyclone separator having an outlet opening at which an insulated, hand held flexible hose is attached.

2. Device according to claim 1, characterized in that an air discharge fan is installed in the vicinity of said device at the outlet of said flexible hose, valve means in flow communication with said supply of liquid nitrogen and in electrical communication with said air discharge fan for preventing the feed of liquid nitrogen in said connection when said fan is in its non-operating condition.

* * * * *